US005561104A

United States Patent [19]

Miyagawa et al.

[11] Patent Number: 5,561,104

[45] Date of Patent: Oct. 1, 1996

[54] HYDRAULIC WORKING OIL COMPOSITION FOR BUFFERS

[75] Inventors: Toru Miyagawa; Shigeaki Hirata; Mitsuo Okada, all of Yokohama, Japan

[73] Assignee: Nippon Oil Co., Ltd., Tokyo, Japan

[21] Appl. No.: 499,104

[22] Filed: Jul. 6, 1995

Related U.S. Application Data

[63] Continuation-in-part of Ser. No. 136,567, Oct. 13, 1993, abandoned.

[30] Foreign Application Priority Data

Oct. 15, 1992 [JP] Japan ..... 4-301576

[51] Int. Cl.[6] ..... C10M 133/00; C10M 137/00

[52] U.S. Cl. ..... 508/421; 508/433; 508/562

[58] Field of Search ..... 252/78.5, 32.5, 252/49.8, 51.5 R

[56] References Cited

U.S. PATENT DOCUMENTS 4,634,543 1/1987 Okada et al. ..... 252/78.5

5,078,893 1/1992 Ryer et al. ..... 252/49.6

*Primary Examiner*—Prince Willis, Jr.

*Assistant Examiner*—Cephia D. Toomer

*Attorney, Agent, or Firm*—Bucknam and Archer

[57] ABSTRACT

A hydraulic working oil composition for buffers which comprises a lubricating oil as a base oil, (A) a phosphoric acid ester such as dioleyl acid phosphate and/or a phosphorous acid ester such as dioleyl hydrogen phophite, and (B) an adduct of an aliphatic amine such as oleyl amine with an alkylene oxide such as ethylene oxide, the compounds (A) and (B) being the essential components added to said base oil; and, in one embodiment, a process for lubricating buffers which comprises adding said compounds (A) and (B) to said base oil to prepare a hydraulic working oil composition and using the thus prepared oil composition in buffers.

16 Claims, No Drawings

HYDRAULIC WORKING OIL COMPOSITION FOR BUFFERS

This application is a continuation-in-part of application Ser. No. 08/136,567, filed Oct. 13, 1993, now abandoned.

BACKGROUND OF THE INVENTION

1. Field of the Invention

This invention relates to hydraulic working oil compositions for use in buffers and more particularly to such oil compositions suitable for car suspension devices such as shock absorbers, active suspensions, stay dampers and engine dampers.

2. Prior Art

As conventional hydraulic working oils which have hitherto been used in car buffer devices such as shock absorbers, active suspensions, stay dampers and engine dampers, there have been known those incorporated with a phosphoric acid ester and/or a phosphorus acid ester to provide them with friction-reducing properties and wear-preventing properties. In addition, there have also been widely used such hydraulic working oils in which a fatty acid, aliphatic alcohol, fatty acid ester, aliphatic amine and other oily agents are used to further improve the working oils in friction-reducing properties.

For example, a fluid composition for use in shock absorber comprising a boron-containing dispersant and phosphorus-containing compounds such as dihydrocarbyl phosphoric acid ester, monohydrocarbyl phosphoric acid ester and dihydrocarbyl phosphoric acid ester in a lubricating base oil is disclosed in U.S. Pat. No. 4,634,543. In addition, a power transmission fluid comprising as an essential component a phosphorous acid triester selected from triaryl phosphite or trialkylaryl phosphite and hydroxylamine in lubricating oil is disclosed in U.S. Pat. No. 5,078,893.

Hydraulic working oils are those which are required to be capable of reducing friction at friction surfaces simultaneously with preventing wear of the friction surfaces. Recently, there have been increasingly used bush members impregnated with a Teflon resin in attempts to reduce friction at friction surfaces from the standpoint of material or substance used. Further, particularly gas-sealed type and damping force-variable type buffer have increasingly been used and, therefore, load applied to the friction surfaces of buffers has been increased and conditions under which the buffers are used have come to be severe.

With a change in such conditions or circumstances under which hydraulic working oils are additionally used, conventional such oils incorporated only with a phosphoric acid ester and/or a phosphorous acid ester, or those in which a fatty acid, aliphatic alcohol, a fatty acid ester and other oily agents are used, have raised problems that they will allow friction surfaces to be considerably worn with their friction-reducing effects being low and poor. In addition, it has been found that the conventional working oils in which is used a phophoric acid ester and/or a phosphorous acid ester as well as an aliphatic amine which is an oily agent, will exhibit somewhat excellent wear-preventing and friction-reducing effects on the friction surfaces of a suspension device at the initial time when the working oils are used therein but the conventional working oils will raise problems that they cannot keep such effects durably and will greatly increase in frictional coefficient during their use whereupon spherical particles produced by the wear of the friction surfaces are attached to the friction surfaces which are the surfaces of a Teflon resin-impregnated bush member.

There has been a great desire to develop novel hydraulic working oils for a buffer which meet new requirements such as excellent applicability to Teflon resin-impregnated bush members and excellent durability (little degradation during the use) of friction-reducing and wear-preventing effects, in addition to the conventional requirements, since the new requirements have become significant.

SUMMARY OF THE INVENTION

The primary object of this invention is to provide hydraulic working oil compositions for a buffer which are excellent in applicability to Teflon resin-impregnated bush members as well as durability (little degradation with the time of use) of friction-reducing and wear-preventing effects.

The present inventors made intensive studies to achieve the object of this invention and, as the result of their studies, found that the combined use of (A) a phosphoric acid ester and/or a phosphorous acid ester and (B) an alkylene oxide of an aliphatic amine in a lubricating oil as a base oil will exert their synergistic effect so as to obtain a new hydraulic working oil exhibiting excellent performances when used, thus completing this invention.

The primary object of this invention is achieved by providing a hydraulic working oil composition for buffers which comprises a lubricating oil as a base oil, (A) at least one ester selected from the group consisting of a phosphoric acid ester and a phosphorous acid ester and (B) an adduct of an aliphatic amine with an alkylene oxide, the compounds (A) and (B) being the essential components added to said base oil, wherein the phosphoric acid ester, the phosphorous acid ester and the adduct of an aliphatic amine with an alkylene oxide, are represented respectively by the following formulae (1), (2) and (3)

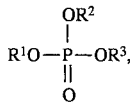

(1)

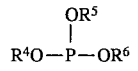

(2)

and

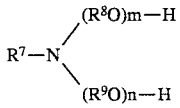

(3)

wherein in the formula (1) the $R^1$ and $R^2$ are each a straight-chain or branched-chain alkyl or alkenyl group having 8–20 carbon atoms or a monoalkylphenyl group having 14–20 carbon atoms in which the alkyl is a straight-chain or branched-chain, and $R^3$ is hydrogen; in the formula (2) the $R^4$ and $R^5$ are each a straight-chain or branched-chain alkyl or alkenyl group having 8–20 carbon atoms or a monoalkylphenyl group having 14–20 carbon atoms in which the alkyl is a straight-chain or branched-chain, and the $R^6$ is hydrogen; and in the formula (3) the $R^7$ is a straight-chain alkyl or alkenyl group having 12–18 carbon atoms, and the $R^8$ and $R^9$ are each an ethylene group; m and n may be identical with, or different from, each other and they are each an integer of 0–10 with the proviso that m plus n equals 1–10, and wherein at least one of said phosphoric acid ester and phosphorous acid ester is added to the base oil in an amount of 0.1–5% by weight of the total amount of the oil composition, and the alkylene oxide adduct of an aliphatic amine is added to the base oil in an amount of 0.01–5% by weight of the total amount of the oil composition.

This invention will be explained below in more detail.

The lubricating oils used as a base oil in this invention are not particularly limited, and both mineral oils and synthetic oils which are usually used as a base oil for lubricating oils may be used as the base oil in this invention.

The mineral oil-type lubricating oils which may be used as a base oil, include paraffinic and naphthenic oils obtained by refining, for example, lubricating oil fractions obtained by the atmospheric and reduced-pressure distillation of a crude oil, by means of a suitable combination of solvent deasphalting, solvent extraction, hydrocracking, solvent dewaxing, catalytic dewaxing, hydrorefining, sulfuric acid washing, clay treatment, and the like.

The syntheticoil-type lubricating oils which may be used as a base oil, include poly α-olefins (polybutene, 1-octene oligomers, 1-decene oligomers, etc.), alkylbenzenes, alkylnaphthalenes, diesters (ditridecyl glutarate, di-2-ethylhexyl adipate, diisodecyl adipate, ditridecyl adipate, di-2-ethylhexyl sebacate, etc.), polyol esters (trimethylolpropane caprylate, trimethylolpropane pelargonate, pentaerythritol 2-ethyl hexanoate, pentaerythritol pelargonate, etc.), polyoxyalkylene glycol, polyphenyl ethers, silicone oil and perfluoroalkyl ethers.

The lubricating oils used as a base oil are hereinafter sometimes referred to as "base lubricating oils" for simplicity.

The base lubricating oils may be used singly or jointly, but the mineral oil-type base lubricating oils are preferably used from the standpoint of their adaptability to, or compatibility with, gum sealants in this invention.

The base lubricating oils used in this invention are optional in viscosity, but those having a viscosity of 8–60 cSt, preferably 10–40 cSt, at 40° C. are usually used from necessity for their applicability to damping force required in general buffers.

The component (A) which is an essential additive to be added to a base lubricating oil according to this invention is a phosphoric acid ester and/or a phosphorous acid ester.

The phosphoric acid ester defined here is a compound represented by the following formula (1)

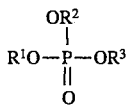

(1)

and the phosphorous acid ester defined here is a compound represented by the following formula (2)

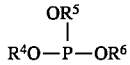

(2)

In these formulae (1) and (2), $R^1$, $R^2$, $R^4$ and $R^5$ may be identical with, or different from, each other respectively, and these $R^1$, $R^2$, $R^4$ and $R^6$ are each a straight-chain or branched-chain alkyl or alkenyl group having 8–20 carbon atoms, or are each a monoalkylphenyl group having 14–20 carbon atoms in which the alkyl group is a straight-chain or branched-chain; $R^3$ and $R^6$ are each a hydrogen.

The $R^1$, $R^2$, $R^4$ and $R^5$ each include an alkyl group such as octyl groups (including all isomeric groups), nonyl groups (including all isomeric groups), decyl groups (including all isomeric groups), undecyl groups (including all isomeric groups), dodecyl groups (including all isomeric groups), tridecyl groups (including all isomeric groups), tetradecyl groups (including all isomeric groups), pentadecyl groups (including all isomeric groups), hexadecyl groups (including all isomeric groups), heptadecyl groups (including all isomeric groups), octadecyl groups (including all isomeric groups), nonadecyl groups (including all isomeric groups), eicosyl groups (including all isomeric groups); an alkenyl group such as octenyl groups (including all isomeric groups), nonenyl groups (including all isomeric groups), decenyl groups (including all isomeric groups), undecenyl groups (including all isomeric groups), dodecenyl groups (including all isomeric groups), tridecenyl groups (including all isomeric groups), tetradecenyl groups (including all isomeric groups), pentadecenyl groups (including all isomeric groups), hexadecenyl groups (including all isomeric groups), heptadecenyl groups (including all isomeric groups), octadecenyl groups (including all isomeric groups), nonadecenyl groups (including all isomeric groups), eicosenyl groups (including all isomeric groups); an alkylaryl group such as octylphenyl groups (including all isomeric groups), nonylphenyl groups (including all isomeric groups), decylphenyl groups (including all isomeric groups), undecylphenyl groups (including all isomeric groups), dodecylphenyl groups (including all isomeric groups), tridecylphenyl groups (including all isomeric groups), tetradecylphenyl groups (including all isomeric groups).

On the other hand, the $R^3$ and also the $R^6$ each hydrogen.

From the standpoint of excellency particularly in wear-preventing and friction-reducing effects, the phosphoric acid ester of the component (A) used in this invention is preferably a compound of the formula (1) wherein $R^1$ and $R^2$ are each a member selected from a straight-chain or branched-chain alkyl or alkenyl group having 8 to 18 carbon atoms and a monoalkylphenyl group having 15–18 carbon atoms in which the alkyl is a straight-chain or branched-chain one, and $R^3$ is hydrogen. The phosphoric acid ester is preferably a compound of the formula (1) wherein $R^1$ and $R^2$ are each a member selected from a straight-chain alkyl or alkenyl group having 8 to 18 carbon atoms, and $R^3$ is hydrogen.

From the standpoint of excellency particularly in wear-preventing and friction-reducing effects in the same manners as in the phosphoric acid ester of the formula (1), the phosphorous acid ester of the component (A) used in this invention is preferably a compound of the formula (2) wherein $R^4$ and $R^5$ are each a member selected from a straight-chain or branched-chain alkyl or alkenyl group having 8 to 18 carbon atoms and a monoalkylphenyl group having 15–18 carbon atoms in which tile alkyl is a straight-chain or branched-chain one, and $R^6$ is hydrogen. The phosphorous acid ester is more preferably a compound of the formula (2) wherein $R^4$ and $R^5$ are each a straight-chain alkyl or alkenyl group having 8 to 18 carbon atoms, and $R^6$ is hydrogen.

The phosphoric acid ester which is among the components (A) used in this invention includes dioetyl acid phosphate (dieapryl acid phosphate), didecyl acid phosphate, didodecyl acid phosphate (dilauryl acid phosphate), ditetradecyl acid phosphate (dimyristyl acid phosphate), dihexadecyl acid phosphate (dipalmityl acid phosphate), dioetadecyl acid phosphate (distearyl acid phosphate) and di-9-oetadecenyl acid phosphate (dioleyl phosphate). The phosphorous acid ester which is among the components (A), includes dioctyl hydrogen phosphite (dicapryl hydrogen phosphite), didecyl hydrogen phosphite, didodecyl hydrogen phosphite (dilauryl hydrogen phosphite), ditetradecyl hydrogen phosphite (dimyristyl hydrogen phosphite), dihexadecyl hydrogen phosphite (dipalmityl hydrogen phosphite), dioctadecyl hydrogen phosphite (distearyl hydrogen phosphite), di- 9-octadecenyl hydrogen phosphite (dioleyl hydrogen phosphite) and a mixture thereof.

In the hydraulic working oil composition for buffers of this invention, the amount of the phosphoric acid ester and/or phosphorous acid ester added is an amount of 0.1 to 5% by weight, preferably 0.5 to 5% by weight, based on the total weight of the composition.

Further, the component (B) which is another essential component used in this invention is an adduct of an aliphatic amine with an alkylene oxide. The alkylene oxide adduct of an aliphatic amine defined in this invention means a compound represeted by the following general formula (3)

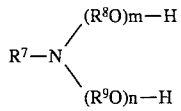

(3)

wherein $R^7$ represents a straight-chain alkyl or alkenyl group having 12–18 carbon atoms, $R^8$ and $R^9$ are each an ethylene group; and m and n may be identical with, or different from, each other and are each an integer of 0–10 with the proviso that m plus n equals 1–10, prefereably 1–5.

The $R^7$ is exemplified by an alkyl group such as dodecyl groups (lauryl group), tridecyl groups, tetradecyl groups (myristly group), pentadecyl groups, hexadecyl groups (palmityl group), heptadecyl groups, octadecyl groups (steartl group), docenyl groups (including all isomeric groups) tridecenyl groups (including all isomeric groups) tetradecenyl groups (including all isomeric groups) pentadecenyl groups (including all isomeric groups) hexadecenyl groups (including all isomeric groups) peptadecenyl groups (including all isomeric groups) octadecenyl groups (including all isomeric groups). The $R^8$ and $R^9$ are an ethylene group.

The particularly preferable alkylene oxide adducts of an aliphatic amine, which are the component (B) used in this invention, include ethylene oxide adducts of an aliphatic amine such as octyl amine (capryl amine), decyl amine, dodecyl amine (lauryl amine), tetradecyl amine (mylystyl amine), hexadecyl amine (palmitil amine), octadecyl amine (stearyl amine) or 9-octadecenyl amine (oleyl amine).

In the hydraulic working oil composition for buffers of this invention, the amount added of the alkylene oxide adduct of an aliphatic amine, which is the component (B), is 0.01 to 5% by weight, preferably 0.05 to 5% by weight, more preferably 0.1 to 5% by weight, based on the total weight of the composition.

As described above, although the hydraulic working oil composition for buffers of this invention having excellent performances can be obtained by only adding to the base lubricating oil the phosphoric ester and/or phosphorous ester which is the component (A), and the alkylene oxide adduct of an aliphatic amine, which is the component (B), into the base lubricating oil. To further enhance the thus obtained hydraulic working oil composition in such performances, heretofore known additives for lubricating oils may be used singly or jointly.

These additives include friction-reducing agents other than the components of the oil composition of this invention, such as an aliphatic alcohol, aliphatic acid, aliphatic amine and aliphatic amide; anti-oxidants such as phenol-, amine-, sulphur-, zinc dithiophosphate- and phenothiazine-based compounds; extreme-pressure agents such as sulfurized fats and oils, sulfides and zinc dithiophosphate; rust preventives such as petroleum sulfonates and dinonylnaphthalene sulfonate; metal deactivators such as benzotriazole and thiadiazole; metallic detergents such as alkaline earth metal sulfonates, alkaline earth metal phenates, alkaline earth metal salicylates and alkaline earth metal phosphonates; ashless dispersants such as succinic imide, succinic esters and benzyl amine; antifoaming agents such as methylsilicone and fluorosilicone; viscosity index improvers such as polymethacrylate, polyisobutylene and polystyrene; and pour point depressants.

Although the amount of these additives added may be arbitrary, the contents of the antifoaming agent, the viscosity index improver, the metal inactivator and each of the other additives in the oil composition are ordinarily 0.0005–1% by weight, 1–30% by weight, 0.005–1% by weight and 0.1–15% by weight in this order, based on the total amount of the oil composition, respectively.

The process for preparing the hydraulic working oil compositions of this invention is not particularly limited. This process, however, may usually comprise mixing a base lubricating oil and additives including the essential components (A) and (B) together, heating the resulting mixture to 30°–100° C. and then maintaining it at this temperature under agitation for 20 minutes to 5 hours, or may comprise separately heating all the additives (solid additives having beforehand been solved ill a small amount of the base lubricating oil) to 30°–100° C., mixing these additives in portions or in full into the base lubricating oil heated to 20°–80° C. and then maintaining the resulting mixture at 30°–100° C. under agitation for 20 minutes to 5 hours.

DISCRIPTION OF PREFERRED EMBODIMENTS

This invention will be better understood by the non-limitative Examples and Comparative Examples.

Examples 1–20 and Comparative Examples 1–10

In each of the Examples, the ingredients shown in Table 1 were mixed together and the resulting mixture was heated to 50° C. under stirring for two hours thereby to prepare a hydraulic working oil composition of this invention (Examples 1–20). The oil compositions of this invention so prepared were subjected to a duration test using an actual device to evaluate them for their friction-reducing effects and wear-preventing effects.

In addition, comparative hydraulic working oil compositions were prepared by following the procedure of the above Examples except that the lubricating oil was used singly (Comp. Example 1), the component (A) was used singly (Comp. Examples 2 and 3), except that the component (B) was used singly (Comp. Examples 4 and 5), except that a triaryl phosphite was substituted for the component (A) (Comp. Example 6), except that a trialkylaryl phosphite was substituted for the component (A) (Comp. Example 7), except that a fatty acid was substituted for the component (A) (Comp. Example 8), except that an aliphatic amine was substituted for the component (B) (Comp. Example 9) and except that a fatty acid was substituted for the component (B) (Comp. Example 10).

The comparative oil compositions so prepared were subjected to the same duration test as above.

Duration Test Using Actual Device

Using two commercially available strut-type shock absorbers, duration tests were made under the following conditions until the end of two million frequency of oscillation application.

Temperature of a test oil: 80° C.

Amount of a test oil used: 330 ml/one shock absorber

Lateral load: 200 kgf

Entire amplitude of oscillation applied: 50 mm

Velocity of oscillation applied: 0.5 m/s (1) Friction-reducing effects

The shock absorbers were measured for their frictional coefficients at their surfaces at the time of oscillation application frequency of zero (at the initial stage of the duration test) and at the time of oscillation application frequency of two millions (at the time of completion of the duration test), respectively. The frictional coefficients so measured are as shown in Table 1.

(2) Wear-preventing effects

After the completion of the duration test, the shock absorbers were disossembled to visually evaluate the surface state of their friction surfaces (cylinders, pistons, rods and oil seals of the shock absorbers) with the results being as shown in Table 1. The degrees of the wear-preventing effects are represented in terms of six numerals 0–5 (numeral 5 being the best).

As is apparent from the results of the Examples, the hydraulic working oil compositions (Examples 1–3) are excellent in friction-reducing effects at the initial stage of the duration test and exhibit less degradation of their friction-reducing performances with the lapse of time in addition, they exhibit less wear at the friction surfaces even at the time of end of the duration test whereby they are also excellent in wear-preventing effects.

Effects of this Invention

As is apparent from the foregoing, the hydraulic working oil compositions of this invention are excellent not only in applicability to Teflon resin-impregnated bush members but also in durability (less degradation with the time) of friction-reducing effects and wear-preventing effects.

TABLE 1

| | | | Example 1 | Example 2 | Example 3 | Example 4 | Example 5 |
|---|---|---|---|---|---|---|---|
| Composition (wt. %) | base oil component (A) | solvent-refined mineral oil *1 | 94.4 | 94.85 | 94.4 | 94.4 | 94.8 |
| | | dioleyl acid phosphate | 1.0 | 1.0 | — | — | 1.0 |
| | | di-2-ethylhexyl acid phosphate | — | — | 1.0 | — | — |
| | | dilauryl acid phosphate | — | — | — | 1.0 | — |
| | | dioleyl hydrogen phosphite | — | — | — | — | — |
| | | di-2-ethylhexyl hydrogen phosphite | — | — | — | — | — |
| | | dilauryl hydrogen phosphite | — | — | — | — | — |
| | component (B) | ethylene oxide adduct of oleyl amine *2 | 0.5 | 0.05 | — | 0.5 | — |
| | | ethyleneooxide adduct of stearyl amine *3 | — | — | — | — | 0.1 |
| | | ethyleneoxide adduct of lauryl amine *4 | — | — | 0.5 | — | — |
| | t-butyl-p-cresol | | 0.6 | 0.6 | 0.6 | 0.6 | 0.6 |
| | polymethacrylate | | 3.5 | 3.5 | 3.5 | 3.5 | 3.5 |
| durability test by real machine *5 | friction-reducing effect | ① friction coefficient (at initial condition) | 0.102 | 0.104 | 0.104 | 0.103 | 0.104 |
| | | ② friction coefficient (at 200 million times) | 0.133 | 0.158 | 0.138 | 0.139 | 0.139 |
| | | ②/① | 1.30 | 1.52 | 1.33 | 1.35 | 1.34 |
| | wear-prevent. effect | surface condition of friction site | 5 | 4 | 5 | 5 | 5 |

| | | | Example 6 | Example 7 | Example 8 | Example 9 | Example 10 |
|---|---|---|---|---|---|---|---|
| Composition (wt. %) | base oil component (A) | solvent-refined mineral oil *1 | 94.4 | 94.9 | 91.9 | 91.9 | 90.9 |
| | | dioleyl acid phosphate | 1.0 | 0.5 | 2.0 | 1.0 | 1.0 |
| | | di-2-ethylhexyl acid phosphate | — | — | — | — | — |
| | | dilauryl acid phosphate | — | — | — | — | — |
| | | dioleyl hydrogen phosphite | — | — | — | — | — |
| | | di-2-ethylhexyl hydrogen phosphite | — | — | — | — | — |
| | | dilauryl hydrogen phosphite | — | — | — | — | — |
| | component (B) | ethylene oxide adduct of oleyl amine *2 | — | 0.5 | 2.0 | 3.0 | 4.0 |
| | | ethyleneooxide adduct of stearyl amine *3 | 0.5 | — | — | — | — |
| | | ethyleneoxide adduct of lauryl amine *4 | — | — | — | — | — |
| | t-butyl-p-cresol | | 0.6 | 0.6 | 0.6 | 0.6 | 0.6 |
| | polymethacrylate | | 3.5 | 3.5 | 3.5 | 3.5 | 3.5 |
| durability test by real machine *5 | friction-reducing effect | ① friction coefficient (at initial condition) | 0.101 | 0.104 | 0.101 | 0.103 | 0.102 |
| | | ② friction coefficient (at 200 million times) | 0.133 | 0.138 | 0.130 | 0.132 | 0.133 |
| | | ②/① | 1.32 | 1.33 | 1.29 | 1.28 | 1.30 |
| | wear-prevent. effect | surface condition of friction site | 5 | 5 | 5 | 5 | 5 |

TABLE 1-continued

| | | | Example 11 | Example 12 | Example 13 | Example 14 | Example 15 |
|---|---|---|---|---|---|---|---|
| Composition (wt. %) | base oil | solvent-refined mineral oil *1 | 89.9 | 91.8 | 90.4 | 94.4 | 94.4 |
| | component (A) | dioleyl acid phosphate | 1.0 | 4.0 | 5.0 | — | — |
| | | di-2-ethylhexyl acid phosphate | — | — | — | — | — |
| | | dilauryl acid phosphate | — | — | — | — | — |
| | | dioleyl hydrogen phosphite | — | — | — | 1.0 | — |
| | | di-2-ethylhexyl hydrogen phosphite | — | — | — | — | 1.0 |
| | | dilauryl hydrogen phosphite | — | — | — | — | — |
| | component (B) | ethylene oxide adduct of oleyl amine *2 | 5.0 | 0.1 | 0.5 | 0.5 | — |
| | | ethyleneooxide adduct of stearyl amine *3 | — | — | — | — | — |
| | | ethyleneoxide adduct of lauryl amine *4 | — | — | — | — | 0.5 |
| | t-butyl-p-cresol | | 0.6 | 0.6 | 0.6 | 0.6 | 0.6 |
| | polymethacrylate | | 3.5 | 3.5 | 3.5 | 3.5 | 3.5 |
| durability test by real machine *5 | friction-reducing effect | ① friction coefficient (at initial condition) | 0.103 | 0.102 | 0.102 | 0.104 | 0.103 |
| | | ② friction coefficient (at 200 million times) | 0.133 | 0.154 | 0.143 | 0.150 | 0.137 |
| | | ②/① | 1.29 | 1.51 | 1.40 | 1.44 | 1.33 |
| | wear-prevent. effect | surface condition of friction site | 5 | 5 | 5 | 5 | 4 |

| | | | Example 16 | Example 17 | Example 18 | Example 19 | Example 20 |
|---|---|---|---|---|---|---|---|
| Composition (wt. %) | base oil | solvent-refined mineral oil *1 | 94.4 | 94.8 | 94.9 | 91.9 | 91.8 |
| | component (A) | dioleyl acid phosphate | — | — | — | — | — |
| | | di-2-ethylhexyl acid phosphate | — | — | — | — | — |
| | | dilauryl acid phosphate | — | — | — | — | — |
| | | dioleyl hydrogen phosphite | — | 1.0 | 0.5 | 2.0 | 4.0 |
| | | di-2-ethylhexyl hydrogen phosphite | — | — | — | — | — |
| | | dilauryl hydrogen phosphite | 1.0 | — | — | — | — |
| | component (B) | ethylene oxide adduct of oleyl amine *2 | 0.5 | — | 0.5 | 2.0 | 0.1 |
| | | ethyleneoxide adduct of stearyl amine *3 | — | 0.1 | — | — | — |
| | | ethyleneoxide adduct of lauryl amine *4 | — | — | — | — | — |
| | t-butyl-p-cresol | | 0.6 | 0.6 | 0.6 | 0.6 | 0.6 |
| | polymethacrylate | | 3.5 | 3.5 | 3.5 | 3.5 | 3.5 |
| durability test by real machine *5 | friction-reducing effect | ① friction coefficient (at initial condition) | 0.102 | 0.104 | 0.102 | 0.101 | 0.102 |
| | | ② friction coefficient (at 200 million times) | 0.138 | 0.139 | 0.139 | 0.129 | 0.155 |
| | | ②/① | 1.35 | 1.34 | 1.36 | 1.28 | 1.52 |
| | wear-prevent. effect | surface condition of friction site | 5 | 5 | 5 | 5 | 4 |

Note:

*1: kinematic visocity 10cSt (at 40° C.),

*2: $R^a-N(CH_2CH_2-OH)_2$ ($R^a$: oleyl group).

*3: $R^b-NH-(CH_2CH_2O)_2-H$ ($R^b$: stearyl group),

*4: $R^c-N((CH_2CH_2O)_2-H)_2$ ($R^c$: lauryl group).

*5: mean value of two shock absorbers (Strut-type)

TABLE 2

| | | | Comp. Ex. 1 | Comp. Ex. 2 | Comp. Ex. 3 | Comp. Ex. 4 | Comp. Ex. 5 |
|---|---|---|---|---|---|---|---|
| Compo- (wt. %) | base oil | solvent-refined mineral oil *1 | 95.9 | 94.9 | 93.9 | 95.4 | 94.9 |
| | component (A) | dioleyl acid phosphate | — | 1.0 | 2.0 | — | — |
| | component (B) | ethylene oxide adduct of oleyl amine *2 | — | — | — | 0.5 | 1.0 |
| | triphenyl phosphite | | — | — | — | — | — |
| | tri(nonylphenyl) phosphite | | — | — | — | — | — |
| | oleyl amine | | — | — | — | — | — |
| | oleic acid | | — | — | — | — | — |
| | stearic acid | | — | — | — | — | — |
| | t-butyl-p-cresol | | 0.6 | 0.6 | 0.6 | 0.6 | 0.6 |

TABLE 2-continued

| | | | | | | | |
|---|---|---|---|---|---|---|---|
| | polymethacrylate | | 3.5 | 3.5 | 3.5 | 3.5 | 3.5 |
| durability test by real machine *5 | friction-reducing effect | ① friction coefficient (at initial condition) | 0.171 | 0.102 | 0.102 | 0.103 | 0.103 |
| | | ② friction coefficient (at 200 million times) | 0.344 | 0.220 | 0.208 | 0.267 | 0.258 |
| | | ②/① | 2.01 | 2.16 | 2.04 | 2.59 | 2.50 |
| | wear-preventing effect | surface condition of friction site | 2 | 3 | 3 | 2 | 2 |

| | | | Comp. Ex. 6 | Comp. Ex. 7 | Comp. Ex. 8 | Comp. Ex. 9 | Comp. Ex. 10 |
|---|---|---|---|---|---|---|---|
| Compo- (wt. %) | base oil | solvent-refined mineral oil *1 | 94.4 | 94.4 | 94.9 | 94.4 | 94.4 |
| | component (A) | dioleyl acid phosphate | — | — | — | 1.0 | 1.0 |
| | component (B) | ethylene oxide adduct of oleyl amine *2 | 0.5 | 0.5 | 0.5 | — | — |
| | triphenyl phosphite | | 1.0 | — | — | — | — |
| | tri(nonylphenyl) phosphite | | — | 1.0 | — | — | — |
| | oleyl amine | | — | — | — | 0.5 | — |
| | oleic acid | | — | — | 0.5 | — | — |
| | stearic acid | | — | — | — | — | 0.5 |
| | t-butyl-p-cresol | | 0.6 | 0.6 | 0.6 | 0.6 | 0.6 |
| | polymethacrylate | | 3.5 | 3.5 | 3.5 | 3.5 | 3.5 |
| durability test by real machine *5 | friction-reducing effect | ① friction coefficient (at initial condition) | 0.102 | 0.103 | 0.104 | 0.102 | 0.103 |
| | | ② friction coefficient (at 200 million times) | 0.248 | 0.217 | 0.250 | 0.217 | 0.203 |
| | | ②/① | 2.43 | 2.11 | 2.40 | 2.13 | 1.97 |
| | wear-preventing effect | surface condition of friction site | 2 | 2 | 2 | 3 | 3 |

Note:

*1: kinematic viscosity 10cSt (at 40° C.)

*2: $R^a-N(CH_2CH_2-OH)_2$ ($R^a$: oleyl group)

*3 $R^b-NH-(CH_2CH_2O)_2-H$ ($R^b$: stearyl group)

*4: $R^c-N((CH_2CH_2O)_2-H)_2$ ($R^c$: lauryl group)

*5: mean value of two shock absorbers (Strut-type)

What is claimed is:

1. A hydraulic working oil composition for buffers which comprises a lubricating oil as a base oil, (A) at least one ester selected from the group consisting of a phosphoric acid ester and a phosphorous acid ester and (B) an adduct of an aliphatic amine with an alkylene oxide, the compounds (A) and (B) being the essential components added to said base oil, wherein the phosphoric acid ester, the phosphorous acid ester and the adduct of an aliphatic amine with an alkylene oxide, are represented respectively by the following formulae (1), (2) and (3)

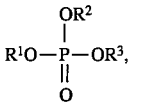

(1)

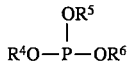

(2)

and

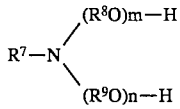

(3)

wherein in the formula (1), the $R^1$ and $R^2$ are each a straight-chain or branched-chain alkyl or alkenyl group having 8–20 carbon atoms, and the $R^3$ is hydrogen; in the formula (2) $R^4$ and $R^5$ are each a straight-chain or branched-chain alkyl or alkenyl group having 8–20 carbon atoms, and the $R^6$ is hydrogen; and in formula (3) the $R^7$ is a straight-chain alkyl or alkenyl group having 12–18 carbon atoms, and the $R^8$ and $R^9$ are each an ethylene group; m and n are the same or different from each other and they are each an integer of 0–10 with the proviso that m plus n equals 1–10, and wherein at least one of said phosphoric acid ester and phosphorous acid ester is added to the base oil in an amount of 0.1–5% by weight of the total amount of the oil composition, and the alkylene oxide adduct of an aliphatic amine is added to the base oil in an amount of 0.01–5% by weight of the total amount of the oil composition.

2. The composition according to claim 1, wherein the m plus n equals 1–5.

3. The composition according to claim 1, wherein the $R^1$, $R^2$, $R^4$ and $R^5$ are each a straight-chain alkyl or alkenyl group having 8–18 carbon atoms.

4. The composition according to claim 2, wherein the $R^1$, $R^2$, $R^4$ and $R^5$ are each a straight-chain alkyl or alkenyl group having 8–18 carbon atoms.

5. The composition according to claim 1, wherein the phosphoric acid ester is dioctyl acid phosphate, didecyl acid phosphate, didodecyl acid phosphate, ditetradecyl acid phosphate, dihexadecyl acid phosphate, dioctadecyl acid phosphate, di-9-octadecenyl acid phosphate or a mixture thereof; the phosphorous acid ester is dioctyl hydrogen phosphite, didecyl hydrogen phosphite, didodecyl hydrogen phosphite, ditetradecyl hydrogen phosphite, dihexadecyl hydrogen phosphite, dioctadecyl hydrogen phosphite, di-9-octadecenyl hydrogen phosphite or a mixture thereof; and the alkylene oxide adduct of an aliphatic amine is an ethylene oxide adduct of octyl amine, decyl amine, dodecyl amine, tetradecyl amine, hexadecyl amine, octadecyl amine or 9-octadecenyl amine.

6. The composition according to claim 2, wherein the phosphoric acid ester is dioctyl acid phosphate, didecyl acid phosphate, didodecyl acid phosphate, ditetradecyl acid phosphate, dihexadecyl acid phosphate, dioctadecyl acid phosphate, di-9-octadecenyl acid phosphate or a mixture thereof; the phosphorous acid ester is dioctyl hydrogen phosphite, didecyl hydrogen phosphite, didodecyl hydrogen phosphite, ditetradecylhydrogen phosphite, dihexadecyl hydrogen phosphite, dioctadecyl hydrogen phosphite, di-9-octadecenyl hydrogen phosphite or a mixture thereof; and the alkylene oxide adduct of an aliphatic amine is an ethylene oxide adduct of octyl amine, decyl amine, dodecyl amine, tetradecyl amine, hexadecyl amine, octadecyl amine or 9-octadecenyl amine.

7. The composition according to claim 3, wherein the phosphoric acid ester is dioctyl acid phosphate, didecyl acid phosphate, didodecyl acid phosphate, ditetradecyl acid phosphate, dihexadecyl acid phosphate, dioctadecyl acid phosphate, di-9-octadecenyl acid phosphate or a mixture thereof; the phosphorous acid ester is dioctyl hydrogen phosphite, didecyl hydrogen phosphite, didodecyl hydrogen phosphite, ditetradecyl hydrogen phosphite, dihexadecyl hydrogen phosphite, dioctadecyl hydrogen phosphite, di-9-octadecenyl hydrogen phosphite or a mixture thereof; and the alkylene oxide adduct of an aliphatic amine is an ethylene oxide adduct of octyl amine, decyl amine, dodecyl amine, tetradecyl amine, hexadecyl amine, octadecyl amine or 9-octadecenyl amine.

8. The composition according to claim 1, wherein the base oil is a paraffinic or naphthenic oil refined by subjecting lubricating oil fractions produced by the atmospheric and reduced-pressure distillation of a crude oil to refining steps selected from solvent deasphalting, solvent extraction, hydrocracking, solvent dewaxing, catalytic dewaxing, hydrorefining, sulfuric washing and clay treatment, or is a synthetic oil selected from the group consisting of polybutene, 1-octene oligomers, 1-decene oligomers, alkylbenzenes, alkylnaphthalenes, tridecyl glutarate, di-2-ethylhexyl adipate, diisodecyl adipate, ditridecyl adipate, di-2-ethylhexyl sebacate, trimethylolpropane caprylate, trimethylolpropane pelargonate, pentaergithritol 2-ethyl hexanoate, pentaergithritol pelargonate, polyoxyalkylene glycol, polyphenyl ethers, silicone oil and perfluoroalkyl ethers.

9. The composition according to claim 2, wherein the base oil is a paraffinic or naphthenic oil refined by subjecting lubricating oil fractions produced by the atmospheric and reduced-pressure distillation of a crude oil to refining steps selected from solvent deasphalting, solvent extraction, hydrocracking, solvent dewaxing, catalytic dewaxing, hydrorefining, sulfuric washing and clay treatment, or is a synthetic oil selected from the group consisting of polybutene, 1-octene oligomers, 1-decene oligomers, alkylbenzenes, alkylnaphthalenes, tridecyl glutarate, di-2-ethylhexyl adipate, diisodecyl adipate, ditridecyl adipate, di-2-ethylhexyl sebacate, trimethylolpropane caprylate, trimethylolpropane pelargonate, pentaerythritol 2-ethyl hexanoate, pentaerythritol pelargonate, polyoxyalkylene glycol, polyphenyl ethers, silicone oil and perfluoroalkyl ethers.

10. The composition according to claim 3, wherein the base oil is a paraffinic or naphthenic oil refined by subjecting lubricating oil fractions produced by the atmospheric and reduced-pressure distillation of a crude oil to refining steps selected from solvent deasphalting, solvent extraction, hydrocracking, solvent dewaxing, catalytic dewaxing, hydrorefining, sulfuric washing and clay treatment, or is a synthetic oil selected from tile group consisting of polybutene, 1-octene oligomers, 1-decene oligomers, alkylbenzenes, alkylnaphthalenes, tridecyl glutarate, di-2-ethylhexyl adipate, diisodecyl adipate, ditridecyl adipate, di-2-ethylhexyl sebacate, trimethylolpropane caprylate, trimethylolpropane pelargonate, pentaerythritol 2-ethyl hexanoate, pentaerythritol pelargonate, polyoxyalkylene glycol, polyphenyl ethers, silicone oil and perfluoroalkyl ethers.

11. The composition according to claim 4, wherein the base oil is a paraffinic or naphthenic oil refined by subjecting lubricating oil fractions produced by the atmospheric and reduced-pressure distillation of a crude oil to refining steps selected from solvent deasphalting, solvent extraction, hydrocracking, solvent dewaxing, catalytic dewaxing, hydrorefining, sulfuric washing and clay treatment, or is a synthetic oil selected from the group consisting of polybutene, 1-octene oligomers, 1-decene oligomers, alkylbenzenes, alkylnaphthalenes, tridecyl glutarate, di-2-ethylhexyl adipate, diisodecyl adipate, ditridecyl adipate, di-2-ethylhexyl sebacate, trimethylolpropane caprylate, trimethylolpropane pelargonate, pentaerythritol, 2-ethyl hexanoate, pentaerythritol pelargonate, polyoxyalkylene glycol, polyphenyl ethers, silicone oil and perfluoroalkyl ethers.

12. A hydraulic working oil composition for buffers according to claim 1, wherein the base oil has a viscosity of 8–60 cSt at 40° C.

13. A hydraulic working oil composition for buffers according to claim 2, wherein the base oil has a viscosity of 8–60 cSt at 40° C.

14. A hydraulic working oil composition for buffers according to claim 3, wherein the base oil has a viscosity of 8–60 cSt at 40° C.

15. A hydraulic working oil composition for buffers according to claim 4, wherein the base oil has a viscosity of 8–60 cSt at 40° C.

16. A hydraulic working oil composition for buffers according to claim 5, wherein the base oil has a viscosity of 8–60 cSt at 40° C.

* * * * *